United States Patent [19]

Hodson

[11] 4,302,127

[45] Nov. 24, 1981

[54] APPLICATOR AND DISTRIBUTOR ASSEMBLY

[76] Inventor: Harry Hodson, 4730 Dunn Dr., Sarasota, Fla. 33583

[21] Appl. No.: 93,846

[22] Filed: Nov. 13, 1979

[51] Int. Cl.[3] ..... E01C 19/38

[52] U.S. Cl. ..... 404/102; 404/108; 404/114

[58] Field of Search ..... 404/102, 106, 105, 108, 404/110

[56] References Cited

U.S. PATENT DOCUMENTS

| | | | |
|---|---|---|---|
| 1,837,529 | 12/1931 | Clifford | 404/102 |
| 1,840,970 | 1/1932 | Noble | 404/102 |
| 1,974,013 | 9/1934 | Clausen | 404/106 |
| 1,993,657 | 3/1935 | Gardiner | 404/106 |
| 2,136,917 | 11/1938 | French | 404/102 X |
| 2,249,264 | 7/1941 | Baily | 404/108 |
| 2,479,800 | 8/1949 | Williams | 404/110 |
| 2,720,822 | 10/1955 | Beatty | 404/102 |
| 3,135,178 | 6/1964 | Guntert | 404/108 |
| 3,188,928 | 6/1965 | Guntert | 404/108 |
| 3,504,598 | 4/1970 | Haker | 404/102 X |

*Primary Examiner*—Nile C. Byers, Jr.
*Attorney, Agent, or Firm*—Arthur W. Fisher, III

[57] ABSTRACT

An apparatus capable of self power or being towed and specifically designed to distribute and/or apply cementitious material, and in particular, pervious concrete, over a given surface area such as a roadway or the like. A support frame has mounted thereon a distributor casing specifically configured to direct cementitious material in layer form along a transverse length relative to the direction of travel of the support frame. A delivery hopper moves transversely on the frame and along the length of the casing and serves to continuously feed cementitious material to the casing. Material such as pervious concrete is continuously discharged from the distributor casing by a percussive action imparted to it by forward motion of the frame. A blade element and compacting edge is adjustably positioned above the surface being treated and is attached to the casing to mechanically move therewith so as to compact the cementitious material as it is extruded from the casing upon mechanical actuation thereof. Finishing units comprising a plurality of finishing plates are activated into compressive engagement with the previously laid layer due to its down steam disposition relative to the outlet of the distributor casing. Thus the material can be distributed, applied and finished in a continuous sequence of operative steps employing the subject apparatus.

17 Claims, 5 Drawing Figures

APPLICATOR AND DISTRIBUTOR ASSEMBLY

BACKGROUND OF THE INVENTION

1. Field of the Invention

This invention relates to an apparatus for distributing a cementitious material over a given surface area and incorporating components which serve to consolidate and finish the cementitious material being applied wherein application and distribution take place in a substantially continuous fashion. The material distributed is normally but not limited to a discontinuous cementitious or concrete material generally forming roadway type surfaces.

2. Description of the Prior Art

In the construction industry particularly in the category of building roads and the like surface areas, concrete or similar material is widely used and is considered among other materials, generally favored for roadway type construction. In such industries the term "concrete" is used generally to define a collection or aggregation of materials which together form a reasonably continuous solid. Prior art products include both Portland cement concrete and a variety of synthetic concretes, such as asphaltic concrete in which inert aggregates are mixed with a bituminous binding component. In Portland cement concrete the object is to obtain a continuous monolithic material with substantially isotropic characteristics. In conventional and by far the majority of normal applications of concrete, voids and/or small discontinuities or inclusions of air are considered to be undesirable since these voids, etc. detract from the operating or performing characteristics of the end concrete product. In particular, the lack of such strength shortens the operable life when roadway surfaces are subjected to high speed heavy weight vehicular traffic. In the specialized category of pervious or similarly discontinuous concretes however, such voids are intentional in the production of the concrete, to produce other advantages. It is still accepted however that such concrete suffers from inherent problems which make the overall product relatively undesirable. In addition to the general lack of performance characteristics due to these derogatory effects on overall strength, prior art discontinuous concretes are generally considered of variable quality and indeterminant permeability. Reliability of such products is therefore questioned for control or specified construction applications.

In applying discontinuous pervious concrete therefore it is particularly important to utilize apparatus which will effectively and efficiently cause the regulated and controlled distribution and consolidation of such material.

Accordingly, there is a great need in the "paving" apparatus industry to develop assemblies, mechanisms, and devices capable of effectively, and efficiently distributing and applying discontinuous concrete type compositions. Such application and distribution should be done on a continuous and controlled basis so as to provide a quality cementitious material product thereby insuring the performance and operative characteristics intended and designed.

SUMMARY OF THE INVENTION

This invention relates to an applicator and distributor assembly of the type which may be commonly referred to as a paver and particularly designed to distribute a cementitious layer on prepared surfaces. One important application of the subject invention is the continuous distribution of discontinuous cementitious material over a road base or the like in an efficient and effective manner.

The distributor and applicator assembly of the present invention comprises a support frame mounted on running gear in the form of a plurality of wheels engaging the surface to be paved or coated. A steering means is secured to the support frame and interconnected to the running gear so as to regulate the direction of movement of the support frame as it travels over the surface.

The structure of the support frame and overall assembly is such as to allow the support frame to be towed or alternately to be self powered through the mounting of an engine of some type directly thereon.

A distribution casing is movably mounted on the support frame and specifically structured and dimensioned to receive the cementitious material in an evenly distributed manner from a delivery means. The distributor casing preferably extends along the transverse dimension of the support frame and is pivotally mounted thereto so as to be continuously displaced from its normal rest position in a manner which will aid in the transfer of the cementitious material therefrom onto the surface being coated or paved.

The delivery means itself is in the form of a hopper which travels over rails associated with the upper portion of the distribution casing and movable along the length thereof in a reciprocal manner so as to constantly and evenly distribute cementitious material from the hopper into the distribution casing.

Displacement means disposed to continuously dislodge the distributor casing in a pivotal movement about its pivotal mounting may be connected in interruptive relation to a portion of the support frame. The displacement means comprises a cam type arrangement driven in independent drive means and serving to regularly dislodge said distributor casing upon forward movement of the support frame.

Outlet means of the distributor casing is in the form of an elongated channel defining the lower portion thereof and having a linear longitudinal configuration which serves to deliver the cementitious material from the interior of the distribution casing onto the surface being paved or coated.

An adjustable striking blade element extends adjacent the elongated channel and is disposed into interruptive engagement by the cam arrangement with the flow of cementitious material therefrom. The adjustable regulation or selective positioning of this blade element serves to determine the thickness and overall quantity of material forming the layer being distributed on the surface being coated. Additionally the continuous displacement of the distributor casing and the attached striker blade causes a percussive action by the blade on the extruded material at the trailing edge of the casing thereby continuously consolidating the extruded material.

In addition, finishing means are attached along the trailing portion of the support frame and disposed in direct engaging relation with the layer being distributed. The finishing means includes a plurality of individual elements each having a finishing plate and a vibratory mechanism attached thereto so as to provide a compacting vibratory force and consolidating movement to the layer being distributed. Each of the units are spaced apart from one another and operate independently from one another in a mechanical sense. However, the plates are dimensioned and configured to effectively work in overlapping relationship to one another so as to not leave seams which delineate the areas between the finishing plates. Free pivotal movement of the plates through activation of the vibration means, etc. is allowed, and adequate support cables or chains serve to maintain the plates in a desired position relative to the layer of material being distributed.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts through out the several views of the drawings.

DETAILED DESCRIPTION OF THE PREFERRED EMBODIMENT

Figure 1:
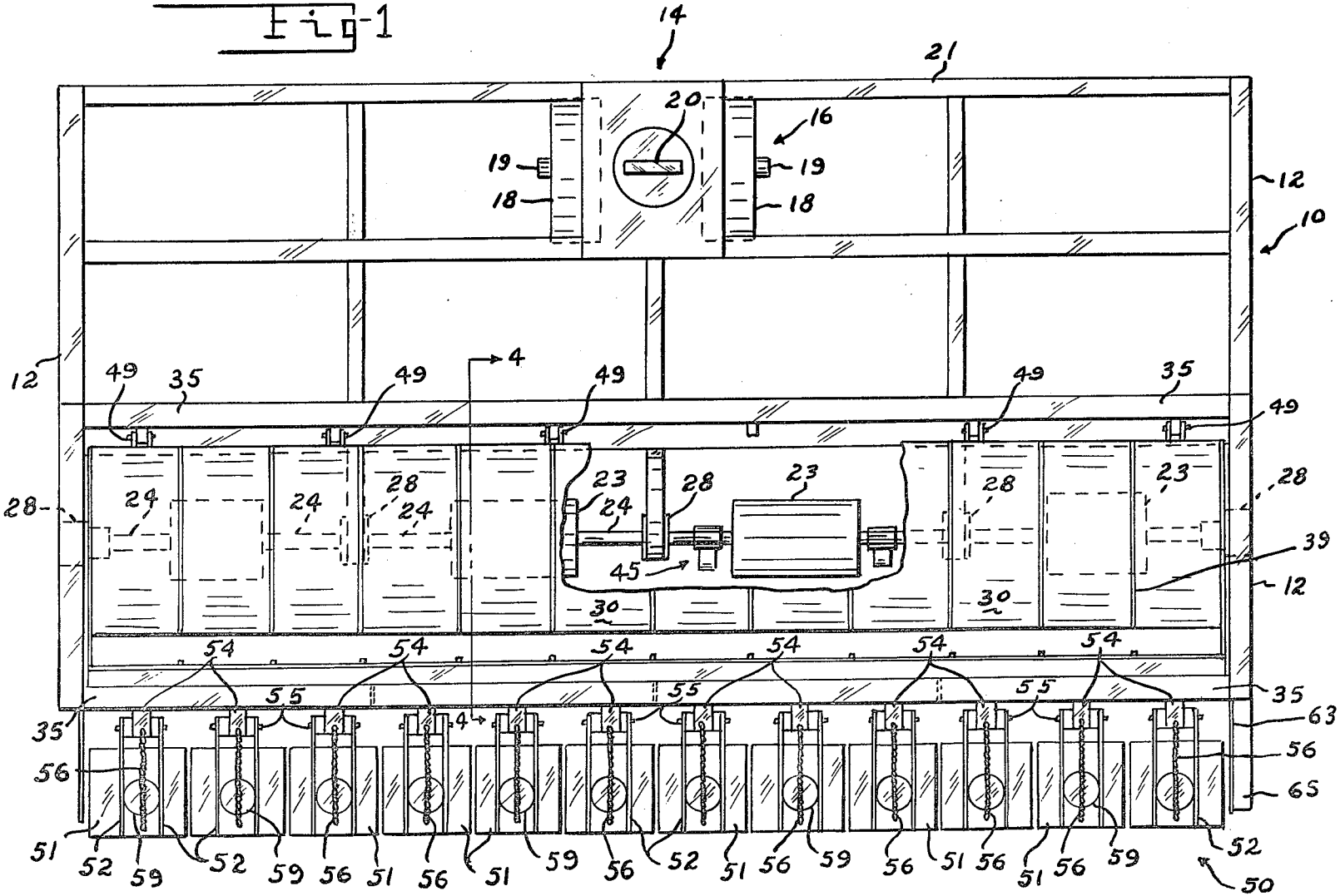
FIG. 1 is a top plan view and partial cut-away showing structural details of the support and the accompanying structure.
Figure 2:
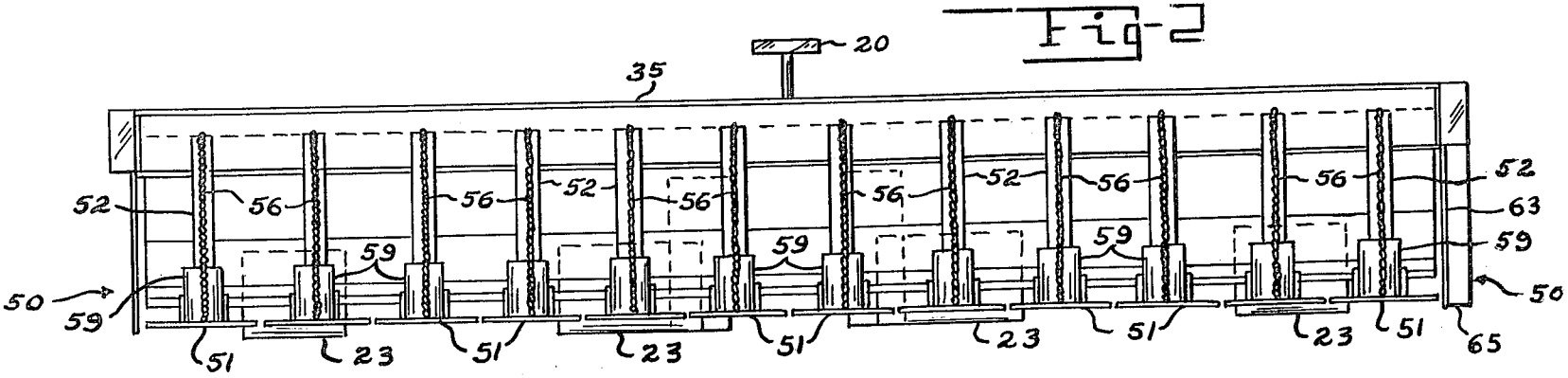
FIG. 2 is a rear elevation view of the embodiment of FIG. 1.
Figure 3:
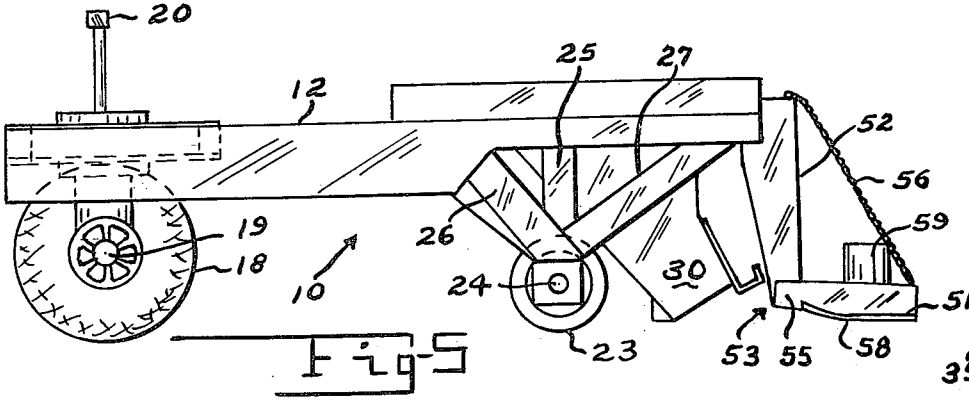
FIG. 3 is a side elevation view of the embodiments of FIGS. 1 and 2.
Figure 5:
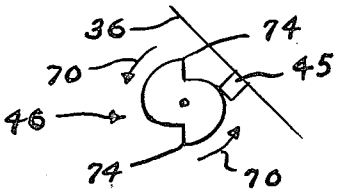
FIG. 5 is a detail of the cam type activator which provides for the feed of cementitious material from the distribution casing.

As shown in FIGS. 1, 2 and 3 the applicator and distributor assembly of the present invention is generally indicated as 10 and includes a support frame 12 having a steering means generally indicated as 14 serving to control at least a portion of the running gear as at 16. The running gear includes leading steering wheels 18 connected to the under carriage or portion of the support frame 12 by an axle 19. Interconnection of the wheels 18 to the steering element 20 allows manipulation of the wheels so as to regulate the direction of the support frame and overall distributor assembly as it travels in a direction towards the leading edge 21. The support frame 12 is structured so as to be either self powered through the mounting of a motor or like assembly on the support frame 12 or alternately to be towed by some type of prime mover vehicle attached in towing relation to the general leading portion 21 of the support frame 12.

The running gear further comprises support wheels 23 mounted on axle 24. The axle 24 is disposed and supported to the under surface of the frame 12 by support legs 25 and support cross ties 26 and 27. Bearing assemblies 28 serve as rotatable interconnection between the support facilities and the shaft 24.

Figure 4:
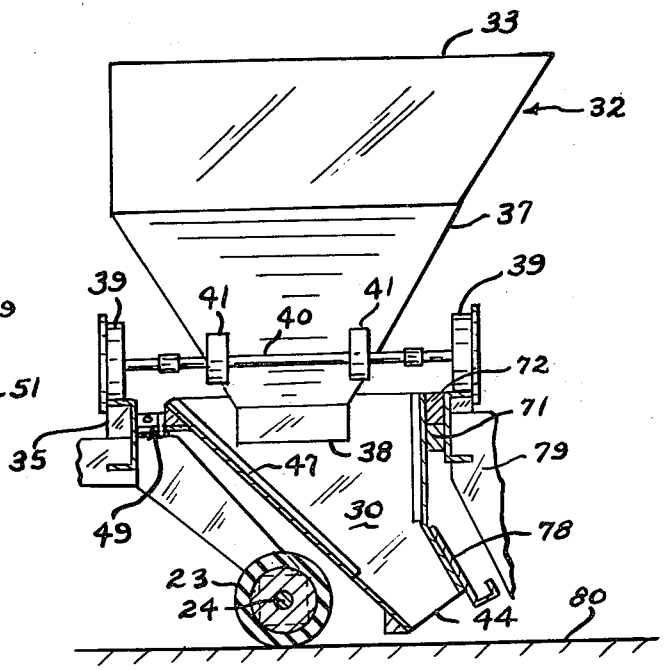
FIG. 4 is a partial cut-away view along line 4—4 FIG. 1, showing structural details of the distribution casing and its relation to the delivery means.

With regard to FIGS. 1, 3 and 4 a distribution casing is generally indicated as 30 and is specifically configured to have the cementitious material deposited therein from a delivery means generally indicated as 32. The delivery means has an open top portion 33 into which the cementitious material is poured from a delivery conveyance such as truck, or bin type container. This delivery means comprises the hopper 37 which travels along rails 35 mounted on the upper portion of the frame 12. The delivery means comprises the distribution casing 30 extending along the transverse dimension of the support frame 12 (FIG. 1). Delivery of the cementitious material from the delivery hopper 37 through outlet 38 occurs along the entire length of the distributor casing 30 into the interior thereof. As set forth above a plurality of running wheels 39 interconnected by shaft 40 and supported on the delivery hopper 37 by mounts 41 allows the delivery hopper 37 to travel evenly across the length or at least a desired, predetermined portion of the length of the distribution casing 30 to deliver cementitious material evenly within distributor casing 30. A plurality of paired stops on opposite sides of the channel 44 each indicated as 43 are disposed laterally across the distribution casing 30 to selectively support an intermediate end plate 51 similar to the end plates at opposite ends of the casing 30 to control the lateral flow of material within the distribution casing 30 to selectively control the width of pavement.

The distributor casing 30 further includes an elongated channel 44 extending along the length and lower portion of the distributor casing 30 for the exiting of the cementitious material therefrom. This delivery is aided through the provision of a displacement means in the form of a cam type element 46 rotatably mounted in interruptive engagement with an exterior portion or foot 45 of the distributor casing 30. The foot 45 projects outwardly of the casing wall 47 and is disposed in periodic interruptive engagement with the exterior surface of the cam element 46 causing displacement or pivotal movement about the pivotal connection 49 of the casing 30. A stop bar 71 is positioned to "catch" or stop the trailing portion 72 of casing 30 when it falls back into its normal rest position. This occurs when foot 45 leaves the upper most point 74 of cam element 46, as at 49 (FIG. 1) to the casing. Accordingly, upon rotation of the cam element 46 about its axis 24 in accord with the directional arrows 70, the casing 30 is periodically displaced and dislodged so as to force the cementitious material therein into a consistent exiting from the interior of the said distributor casing 30.

The distribution means further comprises a striking blade element 78 mounted in adjustable relation adjacent and/or contiguous to the outlet channel 44 so as to compact the layer of material being dispersed therefrom. The blade 78 is adjustably movable in accordance with directional arrow 79 towards and away from the surface or base 80 being covered and over which the vehicle travels. In that the blade element 78 is secured directly to distributor casing 30 it travels therewith. Accordingly, the blade element serves to compact the material against the surface 80 as it exits outlet channel 44. This compactive engagement of blade element 78 with the existing material is produced by the continuous oscillating displacement of casing 30 and its falling back onto stop bar 71 into its normal position. The height of blade element 78 may be adjusted to properly engage the material to allow variation in the thickness and quantity of pavement issuing from the outlet channel 44.

With regard to FIGS. 1 and 2 the finishing assembly is generally indicated as 50 and comprises a plurality of finishing means including in each a finishing plate 51 pivotally attached by support arm 52 as at 53 to the trailing portion of the overall support assembly 12. Connecting lugs 54 are secured to the trailing portion and the pivot link 55 serves as the axis of rotation of the plate. Each of the finishing plates 51 are disposed in spaced apart relation to one another and maintained in a substantially horizontal orientation by the connecting element 56 in the form of a cable or chain.

The finishing assembly 50 further includes an edge finishing means comprising a substantially vertical skirt blade 61 having a substantially horizontal foot plate 63 extending outwardly from the lower portion thereof. The edge finishing means may be adjusted such that the pavement as laid is directed downwardly along the inner surface of the skirt plate 61 immediately adjacent previously laid pavement whereby the foot plate 63 engages the upper surface of the pavement to produce a seamless, smooth surface.

The undersurface of each plate has a substantially curvalinear configuration (FIG. 3) as at 58 to adequately finish the layer in desired fashion. In addition a vibrator assembly 59 may be secured to each of the plates so as to add a vibratory force again serving to adequately finish the material as it leaves the distribution casing.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. An applicator and distributor assembly of the type primarily designed to apply discontinuous pervious cementitious material over a given surface area, said assembly comprising: a support frame including a leading and a trailing portion, running gear movably connected in supporting engagement to said frame and disposed in movable engagement with the surface being treated, a distributor casing mounted on said support frame in communicating relation to the treated surface and including a substantially elongated configuration extending transverse to the direction of assembly travelled over and along a length of surface area being treated, said distributor casing is pivotally attached to said support frame and movable in a displacable manner continuously during distribution of the cementitious material, whereby the material within said distributor casing is shocked to aid flow from said distributor casing, displacement means secured to said support frame and disposed in continuous periodic interruptive contact with said distributor casing, said displacement means disposed and structured for displacing movement of said distributor casing upon each periodic contact therewith, a casing outlet means formed in lower portion thereof in spaced above relation to the surface being treated, said displacement means is rotatably mounted on said support frame running gear and in continuous periodic interruptive engagement with said distributor casing, said distributor casing pivotally mounted for periodic displacement aiding flow of the cementitious material from said distributor casing through said casing outlet means, finishing means disposed substantially adjacent a trailing portion of said assembly and disposed adjacent said casing outlet means and down stream thereof in direct engageable relation with cementitious material flowing from said distributor casing through said outlet means, said finishing means movably secured to said support frame in compressing engagement with the layer of material disposed on the surface area.

2. An assembly as in claim 1 further comprising delivery means movably mounted on said support frame to travel along at least a portion of the length of said distributor casing and in material delivering relation to the interior of said distributor casing.

3. An assembly as in claim 2 wherein said delivery means comprises a hopper assembly, hopper running gear attached to said hopper assembly and disposed to travel transversely along said support frame relative to the direction of travel of said assembly, said hopper assembly configured to direct material from an open top access portion to a lower disposed hopper outlet at least in part by gravity flow, whereby material is dispersed continuously along a predetermined length of said distributor casing upon travel of said hopper assembly.

4. An assembly as in claim 1 further comprising at least one intermediate end plate disposable on the interior of said distributor casing and engageable relation with the interior wall surface thereof and positionable to define at least in part the boundaries of a material containing compartment within said distributor casing, said intermediate end plate positioned for containment of material between an inner surface and one end of said distributor casing.

5. An assembly as in claim 4 further comprising a plurality of support elements each secured at spaced apart intervals to the interior surface of said distributor casing and structured to supportingly engage said intermediate end plate in transverse orientation relative to the longitudinal axis of said distributor casing.

6. An assembly as in claim 1 wherein distributor casing comprises a base wall angularly oriented in a declining relation from an upper to a lower portion thereof and disposed to guide material therein to said casing outlet means extending along a predetermined length of said distributor casing whereby the cementitious material is distributed over the surface area being treated.

7. An assembly as in claim 1 wherein said casing outlet means is disposed contiguous to the lower portion of said distributor casing and is defined by an elongated channel extending along the length of said distributor casing.

8. An assembly as in claim 1 further comprising a striking blade mounted adjacent said elongated channel and down stream thereof, said striking blade extending along the length of said channel in engageable relation to material issuing from said channel.

9. An assembly as in claim 8 wherein said striking blade is adjustably mounted in spaced relation above the surface being treated and positionable to selectively regulate the distance therebetween, whereby the material applied to the surface is compacted by percussive engagement with said striking blade upon displacement of said distributor casing.

10. An assembly as in claim 1 further comprising steering means mounted on said support frame and interconnected to said running gear, whereby direction of travel for said assembly is controlled thereby.

11. An assembly as in claim 1 wherein said finishing means comprises a plurality of material treating units disposed in side by side relation adjacent said trailing portion of said support frame and in compressive engagement with the layer of material issuing from said outlet means.

12. An assembly as in claim 11 further comprising vibrator means interconnected to each of said material treating units and disposed to impart vibratory compressive action thereto relative to the material issuing from said distributor casing onto the surface being treated.

13. An assembly as in claim 11 wherein each material treating unit comprises a finishing plate disposed in engageable relation with material issuing from said distributor casing and interconnected to said vibrator means to impart compressive force to the material issuing from said outlet means.

14. An assembly as in claim 13 wherein each of said finishing plates are configured for side by side at least partially abutting relation to one another and disposed to extend outwardly from the trailing portion of said support frame, down stream of said causing outlet means.

15. An assembly as in claim 13 wherein at least one of said finishing plates comprises an under surface defined by substantially curvilinear sectional configuration disposed for compressive engagement with material placed on the surface being treated.

16. An assembly as in claim 14 wherein each of said finishing plates is pivotally attached to said frame in supporting relation to said vibratory means; retaining means including a flexible line element having one end secured in supported attachment to said support frame and the opposite ends supportingly attached to said finishing plate.

17. An assembly as in claim 1 wherein said displacement means comprises a cam element rotatably mounted on said support frame and disposed in interruptive engagement with an exterior surface portion of said distributor casing.

* * * * *